US009938671B2

(12) United States Patent
Kim et al.

(10) Patent No.: US 9,938,671 B2
(45) Date of Patent: Apr. 10, 2018

(54) REINFORCED CONCRETE PAVEMENT STRUCTURE WITH CRACK INDUCTION PART

(71) Applicants: UNIVERSITY-INDUSTRY COOPERATION GROUP OF KYUNG HEE UNIVERSITY, Yongin-si (KR); DAGIL E&C, Seoul (KR)

(72) Inventors: Seong Min Kim, Seongnam-si (KR); Young Kyo Cho, Suwon-si (KR); Jun Ho Lee, Seoul (KR)

(73) Assignees: UNIVERSITY-INDUSTRY COOPERATION GROUP OF KYUNG HEE UNIVERSITY, Yongin-si (KR); DAGIL E&C, Seoul (KR)

( * ) Notice: Subject to any disclaimer, the term of this patent is extended or adjusted under 35 U.S.C. 154(b) by 0 days.

(21) Appl. No.: 15/196,428

(22) Filed: Jun. 29, 2016

(65) Prior Publication Data

US 2017/0002524 A1 Jan. 5, 2017

(30) Foreign Application Priority Data

Jul. 1, 2015 (KR) ..... 10-2015-0094185

(51) Int. Cl.
*E01C 11/18* (2006.01)
*E01C 11/04* (2006.01)

(52) U.S. Cl.
CPC ..... *E01C 11/18* (2013.01); *E01C 11/04* (2013.01)

(58) Field of Classification Search
CPC . E01C 7/00; E01C 9/001; E01C 11/02; E01C 11/04; E01C 11/06; E01C 11/18
USPC ..... 404/70
See application file for complete search history.

(56) References Cited

U.S. PATENT DOCUMENTS 206,112 A * 7/1878 Hyatt ..... E04C 2/423 404/70
2,015,340 A * 9/1935 Fischer ..... E01C 11/08 404/63
2,651,243 A * 9/1953 Guille ..... E01C 11/02 404/48
3,052,945 A * 9/1962 Cummings ..... E01C 11/02 249/134
3,059,553 A * 10/1962 Woolley ..... E01C 11/14 404/62
3,217,616 A * 11/1965 Maxon, Jr. ..... E01C 11/14 404/59
3,397,626 A * 8/1968 Kornick ..... E01C 11/14 404/134
3,437,017 A * 4/1969 Walz ..... E01C 11/14 404/60

(Continued)

FOREIGN PATENT DOCUMENTS

JP 6-185007 * 5/1994

*Primary Examiner* — Gary S Hartmann
(74) *Attorney, Agent, or Firm* — NSIP Law

(57) ABSTRACT

A transformed continuously reinforced concrete pavement structure using a short reinforcing bar and crack induction. The structure includes a crack induction part combined with short reinforcing bars spaced apart from each other. The short reinforcing bars replace continuous reinforcing bars in a concrete pavement layer of a continuously reinforced concrete pavement structure.

10 Claims, 9 Drawing Sheets

(56) References Cited

U.S. PATENT DOCUMENTS

| | | | | | |
|---|---|---|---|---|---|
| 3,575,094 | A * | 4/1971 | Hewitt | E04F 15/14 | 404/65 |
| 3,702,093 | A * | 11/1972 | Van de Loock | E01C 11/14 | 404/62 |
| 4,449,844 | A * | 5/1984 | Larsen | E01C 11/14 | 404/59 |
| 4,522,531 | A * | 6/1985 | Thomsen | E01C 11/04 | 404/2 |
| 4,648,739 | A * | 3/1987 | Thomsen | E01C 11/227 | 404/2 |
| 5,910,087 | A * | 6/1999 | Carter | E01C 11/106 | 404/50 |
| 7,334,962 | B1 * | 2/2008 | Shaw | E01C 11/06 | 404/48 |
| 7,381,007 | B2 * | 6/2008 | Shaw | E01C 11/06 | 404/48 |
| 8,511,935 | B1 * | 8/2013 | Thomas | E01C 11/14 | 404/135 |
| 8,869,489 | B2 * | 10/2014 | Findlay | E01C 11/126 | 52/677 |

* cited by examiner

REINFORCED CONCRETE PAVEMENT STRUCTURE WITH CRACK INDUCTION PART

CROSS REFERENCE TO RELATED APPLICATION

The present application claims priority to Korean Patent Application No. 10-2015-0094185, filed Jul. 1, 2015, the entire contents of which is incorporated herein for all purposes by this reference.

BACKGROUND OF THE INVENTION

Field of the Invention

The present invention relates generally to a transformed continuously reinforced concrete pavement structure, in which short reinforcing bars are placed between continuous reinforcing bars in a concrete pavement layer, and the structure allows cracks to be induced by providing a crack induction part at a position where the short reinforcing bars are provided. Thus, the present invention allows the short reinforcing bar and the continuous reinforcing bar to control the induced cracks together and the continuous reinforcing bar to control naturally formed cracks between the induced cracks, thereby minimizing the number of reinforcing bars to be used and improving pavement performance.

Description of the Related Art

Generally, concrete pavement reduces shear and bending stresses occurring due to traffic loads to less than or equal to a support force of a concrete pavement layer under a concrete slab by allowing the concrete slab to resist shear and bending due to the traffic loads, thereby maintaining the structural stability of the concrete pavement. Structurally, the type of concrete pavement of the related art includes a jointed plain concrete pavement (JPCP), a jointed reinforced concrete pavement (JRCP), and a continuously reinforced concrete pavement (CRCP), etc. according to whether reinforcing bars or joints are or are not used.

Among the concrete pavements mentioned above, continuously reinforced concrete pavement (CRCP) allows transverse cracks to occur without joints by pouring concrete after arranging reinforcing bars longitudinally and continuously. Since the continuously reinforced concrete pavement doesn't have joints formed artificially by cutting, it offers high riding comfort and is longer in life than other concrete pavements.

However, in the continuously reinforced concrete pavement of the related art, longitudinal reinforcing bars exist to prevent cracks from widening in crack regions, and although the longitudinal reinforcing bars do not need to exist between the crack regions, they are continuously arranged irrespective of the crack regions without information of the crack regions. Accordingly, although continuous reinforcing bars perform the function of reinforcement for preventing a naturally formed crack, they are problematic because an excessive number of bars is used in regions where naturally formed cracks are unlikely to occur.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Patent No. 10-1245828

SUMMARY OF THE INVENTION

Accordingly, the present invention has been made keeping in mind the above problems occurring in the related art, and the present invention is intended to propose a transformed continuously reinforced concrete pavement (CRCP) structure that can efficiently control cracks while providing an arrangement reducing a number of continuous reinforcing bars.

In order to achieve the above object, according to one aspect of the present invention, there is provided a transformed continuously reinforced concrete pavement structure using a short reinforcing bar and crack induction, the structure including: a crack induction part combined with short reinforcing bars arranged to be spaced apart from each other, the short reinforcing bars replacing a predetermined number of continuous reinforcing bars in a concrete pavement layer of a continuously reinforced concrete pavement (CRCP) structure.

For example, the crack induction part may be embedded in the concrete pavement layer in a direction orthogonal thereto, the crack induction part including an anti-attaching treatment layer on at least one surface thereof.

In addition, the crack induction part may be made of concrete, and is configured to have a triangular cross-sectional shape at an upper part thereof so as to form an inclined surface on one surface of the upper part, and to have a rectangular cross-sectional shape at a lower part thereof, the crack induction part including the anti-attaching treatment layer formed on a surface opposite to the inclined surface.

Furthermore, the anti-attaching treatment layer may become oleophilic by applying a hydrophobic surfactant to the anti-attaching treatment layer.

For example, the crack induction part may be a membrane having a shape of a sheet provided in the concrete pavement layer.

For example, the crack induction part may be a cut groove formed on an upper surface of the concrete pavement layer.

For example, in a lower part of the crack induction part, support frames may be provided beneath opposite ends of a pair of transverse reinforcing bars, the short reinforcing bars may be provided on the transverse reinforcing bars provided on the support frames so as to be orthogonal to the transverse reinforcing bars, and the continuous reinforcing bar may be arranged between the short reinforcing bars.

For example, in the crack induction part, the short reinforcing bar may be embedded in the lower part of the crack induction part so as to be exposed to an outside of the lower part at opposite ends of the short reinforcing bar, a transverse reinforcing bar may be embedded in the lower part of the crack induction part so as to be orthogonal to the short reinforcing bar, an opening is formed between portions in which the short reinforcing bars are embedded so as to expose the transverse reinforcing bar, and the continuous reinforcing bar may be arranged in the opening so as to be supported by the transverse reinforcing bar.

In addition, the short reinforcing bar may include downward bent parts at the opposite ends thereof, the downward bent parts including an assistant transverse reinforcing bar therebetween, wherein the continuous reinforcing bar is supported both by the transverse reinforcing bar and by the assistant transverse reinforcing bar.

Meanwhile, the present invention may present a manufacturing method of the structure.

The transformed continuously reinforced concrete pavement structure according to the present invention can allow cracks to be induced by replacing the predetermined number of the continuous reinforcing bars in the concrete pavement layer of the continuously reinforced concrete pavement (CRCP) structure with the short reinforcing bars, thereby realizing economic and work efficiencies while producing a reinforced concrete structure, and preventing a reduction in the structural stability due to arrangement of excessive number of continuous reinforcing bars.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, exemplary embodiments of the present invention will be described in detail with reference to the accompanying drawings. In describing the present invention, terms or words used in this specification and claims should be interpreted in the meaning and concept that corresponds to the technological spirit of the present invention, based on the principle that an inventor may properly define the concept of terms in order to describe the invention in the best mode.

Figure 1A:
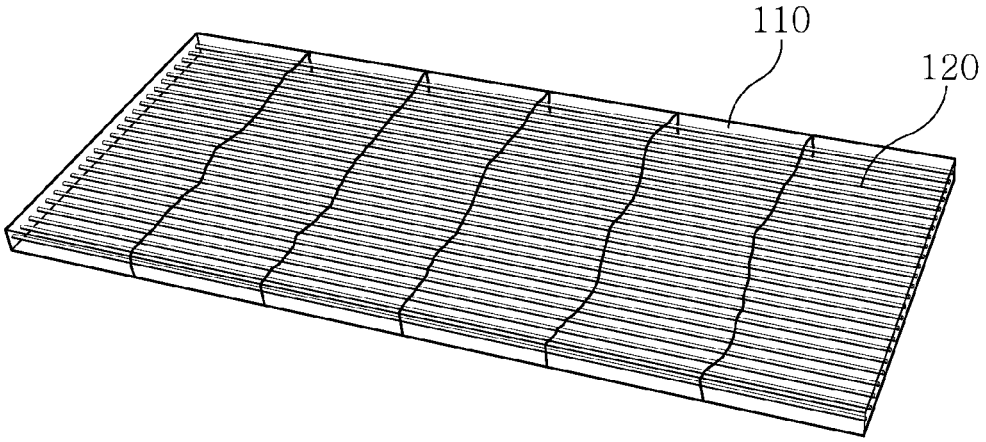
FIGS. 1A and 1B are comparative views of a continuously reinforced concrete pavement structure and a transformed continuously reinforced concrete pavement structure according to the present invention, respectively.
Figure 1B:
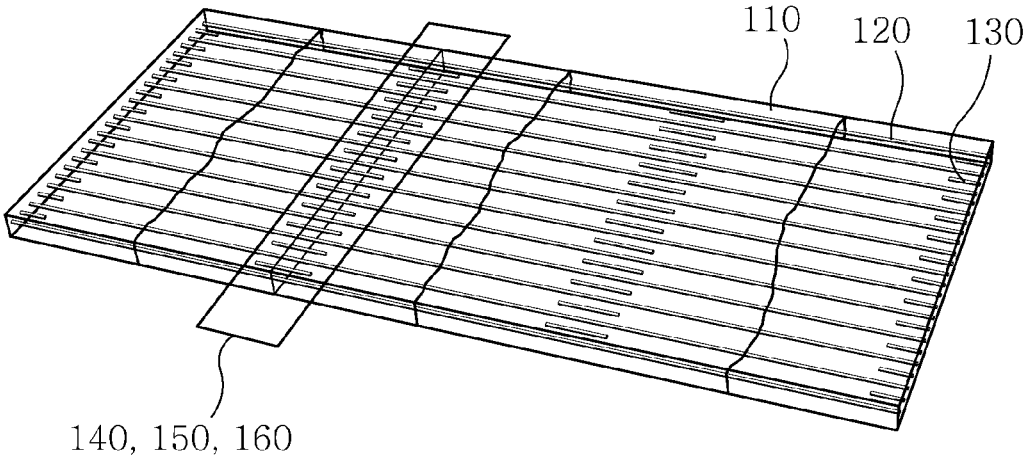

According to the present invention, as shown in FIG. 1B, a transformed continuously reinforced concrete pavement structure 100 using a short reinforcing bar and crack induction includes: crack induction parts 140, 150, and 160 combined with short reinforcing bars 130 arranged to be spaced apart from each other, the short reinforcing bars replacing a predetermined number of continuous reinforcing bars 120 in a concrete pavement layer 110 of a continuously reinforced concrete pavement (CRCP) structure. That is, the structure 100 according to the present invention includes the crack induction parts 140, 150, and 160 so as to induce cracks at a position having the short reinforcing bars 130 spaced apart from each other, the short reinforcing bars replacing a predetermined number of continuous reinforcing bars 120 in a concrete pavement layer 110 of a continuously reinforced concrete pavement (referred to as CRCP hereinbelow) structure shown in FIG. 1A, thereby realizing economic efficiency by reducing the number of the continuous reinforcing bars 120 to be arranged, and solving the problem of concrete filling due to close arrangement of the continuous reinforcing bars 120. Additionally, the structure of the present invention allows initial crack intervals to be evenly distributed by inducing the cracks, and the short reinforcing bars to be arranged only in the crack-induced regions, thereby increasing resistance to the cracks.

Figure 2A:
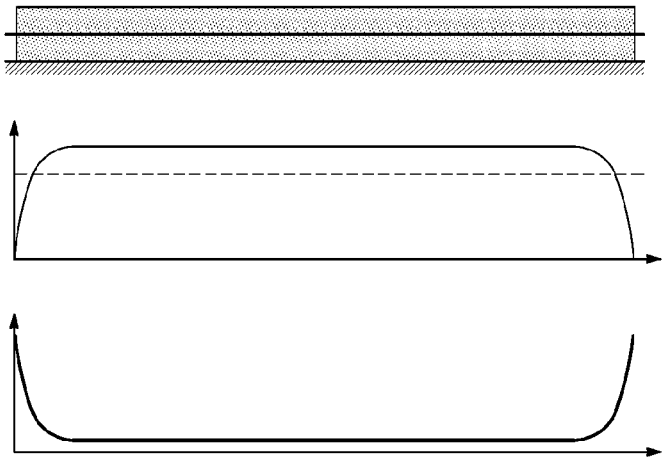
FIGS. 2A to 2C are graphs showing stresses that change in the continuously reinforced concrete pavement structure and the structure of the present invention.
Figure 2B:
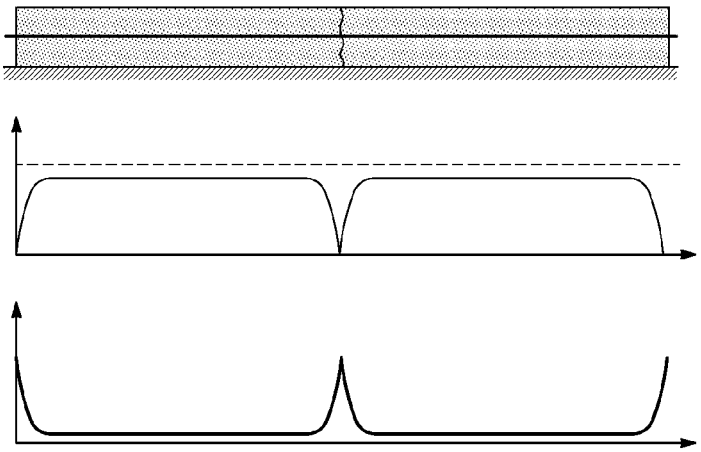
Figure 2C:
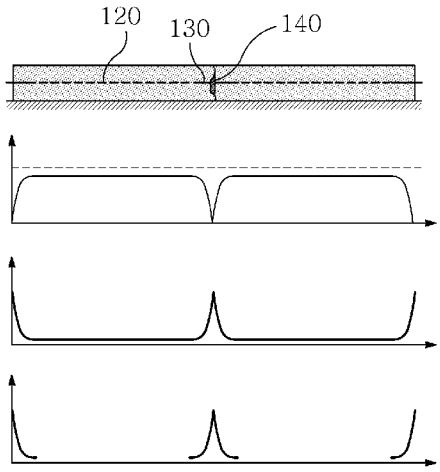

To be more specific, in the case of the CRCP structure shown in FIG. 1A, the continuous reinforcing bars 120 are closely arranged in the concrete pavement layer 110 to respond to a naturally formed crack. However, at the initial stage of construction at which the width of cracks is big, as shown in FIG. 2A, the tensile stress of concrete increases in the middle part of the CRCP structure, and the tensile stresses of the continuous reinforcing bars 120 increase in crack regions due to a decrease in temperature or the presence of moisture, which are environment loads, and when the tensile stresses of the continuous reinforcing bars 120 are higher than the tensile stress of concrete, additional cracks occur. In the CRCP structure, as shown in FIG. 2B, since the continuous reinforcing bars are installed to control the increase of crack width, the tensile stresses of the continuous reinforcing bars 120 are low in other regions except for the crack regions Accordingly, in consideration of the low contribution of the continuous reinforcing bars 120 between the crack regions in the CRCP structure of the related art, as shown in FIG. 2C, the structure of the present invention allows each of the crack induction parts 140, 150, and 160 to induce a crack, and the short reinforcing bar 130 to be arranged only in the crack induced regions. According to such an operation mode, the title of the present invention is referred to as a transformed continuously reinforced concrete pavement structure using a short reinforcing bar and crack induction.

Figure 3A:
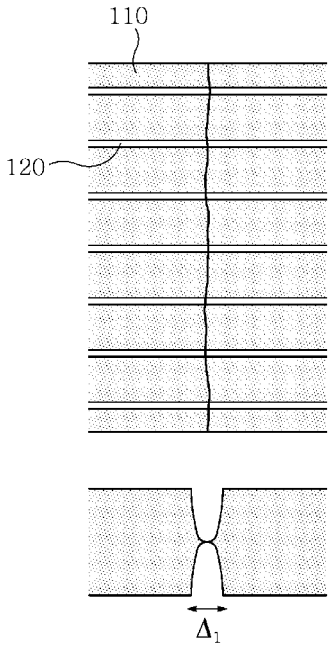
FIGS. 3A to 3C are views showing the widths of cracks that occur in the continuously reinforced concrete pavement structure and the structure of the present invention.
Figure 3B:
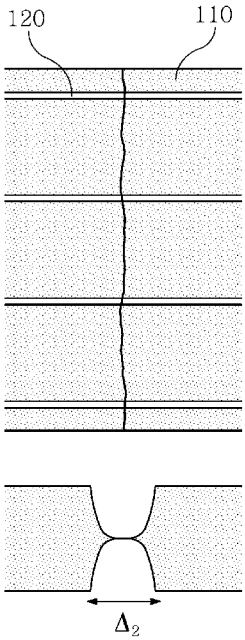
Figure 3C:
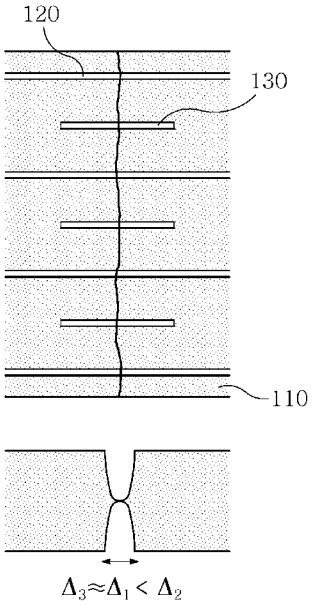

Suppose that when only the continuous reinforcing bars 120 are arranged as in the case of the CRCP structure of the related art, the width of the naturally formed crack is $\Delta 1$. As shown in FIG. 3B, however, when fewer continuous reinforcing bars 120 are arranged than as shown in FIG. 3A, the width $\Delta 2$ of the naturally formed crack increases more than the width $\Delta 1$ shown in FIG. 3A. However, according to the present invention, as shown in FIG. 3C, when the structure of the present invention allows a crack to be induced by allowing the same number of the continuous reinforcing bars as shown in FIG. 3B to be arranged, the short reinforcing bars 130 to be arranged between the continuous reinforcing bars 120, and the crack induction parts 140, 150, and 160 (not shown) to be provided on the regions at which the short reinforcing bars 130 are arranged, the width $\Delta 3$ of the induced crack becomes similar to the width $\Delta 1$ of the naturally formed crack occurring as shown in FIG. 3A, where the continuous reinforcing bars 120 are arranged according to the CRCP structure of the related art.

As shown in FIG. 1B, each of the crack induction parts 140, 150, and 160 is combined with the short reinforcing bars 130. The crack induction parts 140, 150, and 160 according to three embodiments of the present invention will be described hereinbelow.

Figure 4A:
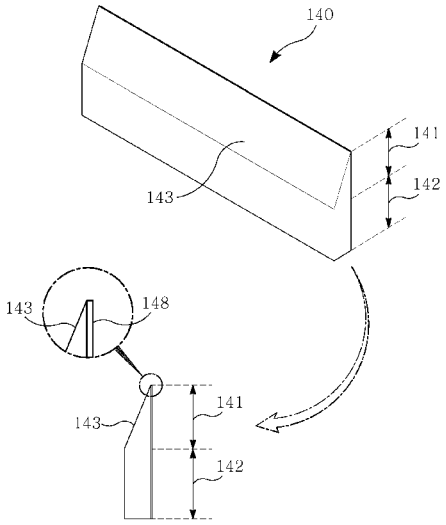
FIGS. 4A to 4C are perspective views and an operation state view of a crack induction part according to a first embodiment of the present invention.
Figure 4B:
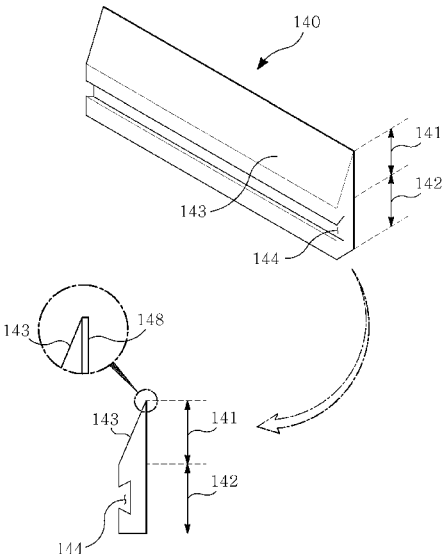
Figure 4C:
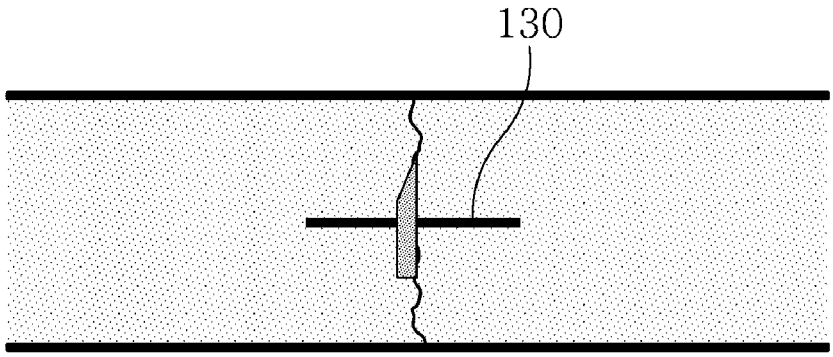

First, the crack induction part 140 is shown in FIGS. 4A to 4C.

According to the first embodiment of the present invention, the crack induction part 140 is embedded in the concrete pavement layer 110 in a direction orthogonal thereto, and is configured to have the shape of a triangular cross-section at an upper part 141 thereof so as to form an inclined surface 143 on one surface of the upper part 141, and to have a shape of a rectangular cross-section at a lower part 142 thereof. In addition, the crack induction part 140 is entirely made of concrete so as to increase the attaching force of the crack induction part with the concrete pavement layer 110, and includes an anti-attaching treatment layer 148 formed on a surface opposite to the inclined surface 143.

The reason that the inclined surface 143 is provided on the upper part 141 is to allow concrete filling to be secured by the inclined surface 143 when pouring concrete for forming the concrete pavement layer 110 by arranging the crack induction part 140 in the concrete pavement layer before pouring the concrete into the concrete pavement layer 110.

The reason that the crack induction part 140 is made of concrete according to the first embodiment of the present invention is to increase the attaching force of the crack induction part 140 with the concrete pavement layer 110. However, the crack induction part 140 includes the anti-attaching treatment layer 148 formed on one surface thereof such that the crack induction part 140 is not attached to the concrete pavement layer 110 at the surface, thereby inducing a crack from the surface on which the anti-attaching treatment layer 148 is formed.

As shown in FIG. 4B, in the lower part 142, an insertion groove 144 is further provided on a surface opposite to the anti-attaching treatment layer 148 so as to double the attaching force of the crack induction part with the concrete pavement layer 110 on the surface opposite to the anti-attaching treatment layer 148 in the crack induction part 140. Accordingly, the crack induction part 140 is embedded in the concrete pavement layer 110, thereby preventing the structural stability of the concrete pavement layer from being lowered.

According to the present invention, the anti-attaching treatment layer 148 becomes oleophilic by applying a hydrophobic surfactant to the anti-attaching treatment layer. In the crack induction part 140, the hydrophobic surfactant is applied to a surface opposite to the inclined surface 143 so as to make the surface oleophilic. Accordingly, one surface of the crack induction part 140 becomes oleophilic so as to form the anti-attaching treatment layer 148 such that a hydrogen bond between cement paste forming the concrete pavement layer 110 and the crack induction part 140 is entirely prevented, thus an attaching force is prevented from occurring. It is preferred that the hydrophobic surfactant includes one selected from polyoxyethylene stearyl ether derivatives, sorbitan fatty acid ester derivatives, and polyoxyethylene oleylamine derivatives, or a combination thereof.

Figure 8:
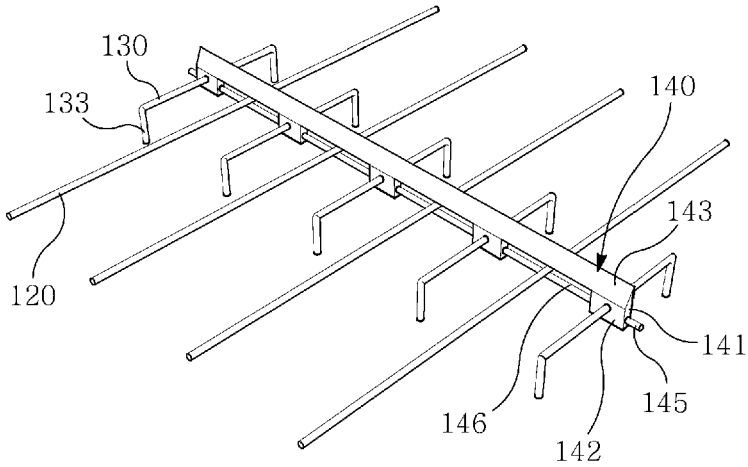
FIGS. 8-10 are perspective views and an operation state view of a crack induction part showing further embodiments of the short reinforcing bar arrangement, respectively, according to the present invention.
Figure 9:
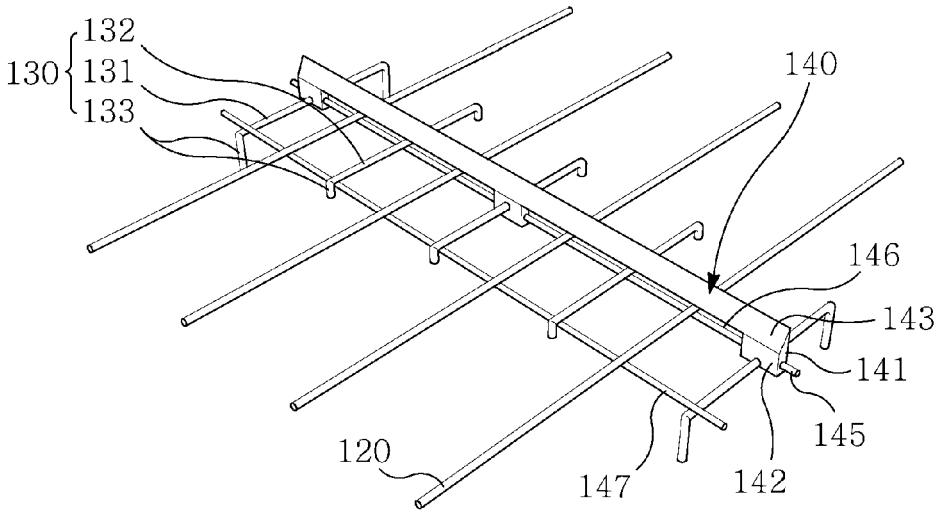

In addition, according to the present invention, as shown in FIGS. 8 and 9, the crack induction part 140 and the short reinforcing bars 130 are precast so as to facilitate the installation thereof in a work place.

Figure 10:
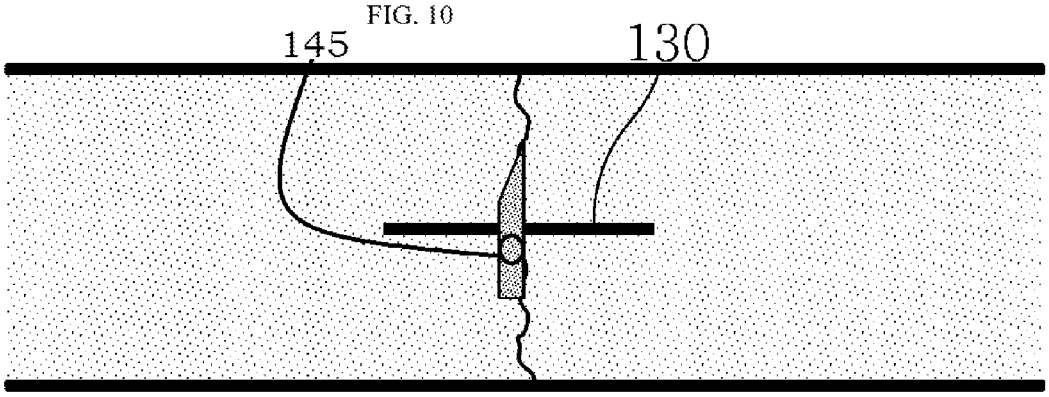

As shown in FIGS. 8-10, in the crack induction part 140, the short reinforcing bars 130 are embedded in the lower part 142 of the crack induction part so as to be exposed to an outside of the lower part 142 at opposite ends of each of the short reinforcing bars 130, a transverse reinforcing bar 145 is embedded in the lower part 142 of the crack induction part so as to be orthogonal to the short reinforcing bars 130, an opening 146 is formed between portions in which the short reinforcing bars 130 are embedded so as to expose the transverse reinforcing bar 145, and each of continuous reinforcing bars 120 is arranged in the opening 146 so as to be supported by the transverse reinforcing bar 145.

That is, according to an embodiment of a short reinforcing bar arrangement of the present invention, as shown in FIGS. 8-10, a crack induction part 140 and short reinforcing bars 130 are precast so as to facilitate the installation thereof at the work place, and further, due to the installation of the crack induction part 140 and the short reinforcing bars 130 that are precast, without using support frames, the continuous reinforcing bar 120s are supported by the transverse reinforcing bar 145 while passing through the opening 146 so as to facilitate the installation of the continuous reinforcing bars 120 according to the arrangement intervals thereof. In this case, the short reinforcing bar 130 includes each of bent parts 133 at the opposite ends thereof such that each of the crack induction part 140 and the short reinforcing bars 130 that are precast is supported on the ground by the bent parts 133. According to the embodiment of the short reinforcing bar arrangement shown in FIG. 8, the number of the continuous reinforcing bars 120 is decreased and the resistance of the continuous reinforcing bars 120 against a crack is increased by the crack induction part and the short reinforcing bars 130. Further, the installation of the short reinforcing bars 130 and the crack induction part 140 becomes efficient, and the installation of the continuous reinforcing bars 120 is also facilitated by the installation of the short reinforcing bars 130 and the crack induction part 140.

Furthermore, according to another embodiment of the short reinforcing bar arrangement of the present invention, as shown in FIG. 9, each of short reinforcing bars 130 includes downward bent parts 133 at the opposite ends thereof, which is the same as the configuration shown in FIG. 8, and the downward bent parts 133 are further provided with an assistant transverse reinforcing bar 147 therebetween such that when the continuous reinforcing bars 120 are arranged, the continuous reinforcing bars 120 are supported both by the transverse reinforcing bar 145 and by the assistant transverse reinforcing bar 147, and thus the arrangement of the continuous reinforcing bars 120 becomes more efficient and stable. According to the embodiment of the short reinforcing bar arrangement shown in FIG. 9, the short reinforcing bar 130 may include short reinforcing bars 132 between outermost short reinforcing bars 131, but the configuration of this embodiment of the short reinforcing bar arrangement is different from the configuration of the embodiment of the short reinforcing bar arrangement shown in FIG. 8 in that only the bent parts 133 of the outermost short reinforcing bars 131 are further extended in downward directions to be fixed to the ground, and bent parts 133 of the short reinforcing bars 132 between the outermost short reinforcing bars 131 are short, and thus when the short reinforcing bars 132 are installed, the short reinforcing bars 132 are maintained above the ground. That is, the bent parts 133 of the outermost short reinforcing bars 131 are fixed to the ground, support the assistant transverse reinforcing bar 147, and secure the installation length of the assistant transverse reinforcing bar 147. The bent parts 133 of the short reinforcing bars 132 between the outermost short reinforcing bars 131 also secure the installation length of the assistant transverse reinforcing bar 147, and are supported by the transverse reinforcing bar 145 and the assistant transverse reinforcing bar 147.

Figure 5:
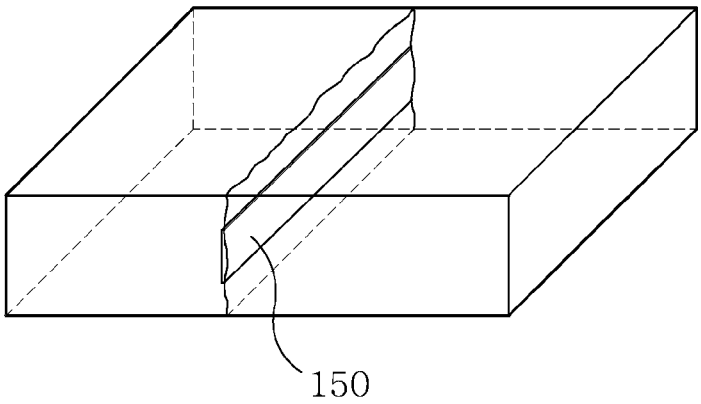
FIG. 5 is an operation state view of a crack induction part according to a second embodiment of the present invention.

Meanwhile, according to the embodiment of the present invention, as shown in FIG. 5, a crack induction part 150 is embedded in the concrete pavement layer 110 in a direction orthogonal thereto, and is configured to have a shape of a sheet the crack induction part 150 being a membrane for forming the anti-attaching treatment layers 148 on opposite surfaces of the crack induction part 150. Preferably, the crack induction part 150 is made of materials, such as vinyl or plastic, that have different characteristics than concrete. That is, the crack induction part 150 is embedded in the concrete pavement layer 110, which reduces the cross-section of the concrete pavement layer, so as to induce a crack at a position at which the crack induction part 150 is provided.

Figure 6:
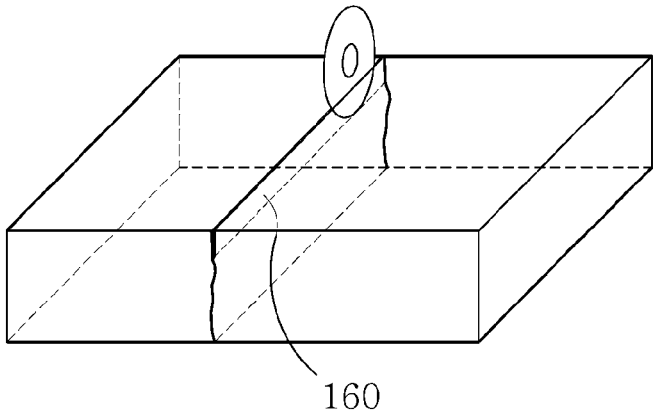
FIG. 6 is an operation state view of a crack induction part according to a third embodiment of the present invention.

In addition, according to the third embodiment of the present invention, as shown in FIG. 6, the crack induction part 160 is a cut groove formed on an upper surface of the concrete pavement layer 110. In this case, the crack induction part 160 having a shape of the cut groove reduces the cross-sectional area of the concrete pavement layer, thereby inducing cracks at a position at which the crack induction part 160 is provided.

Figure 7:
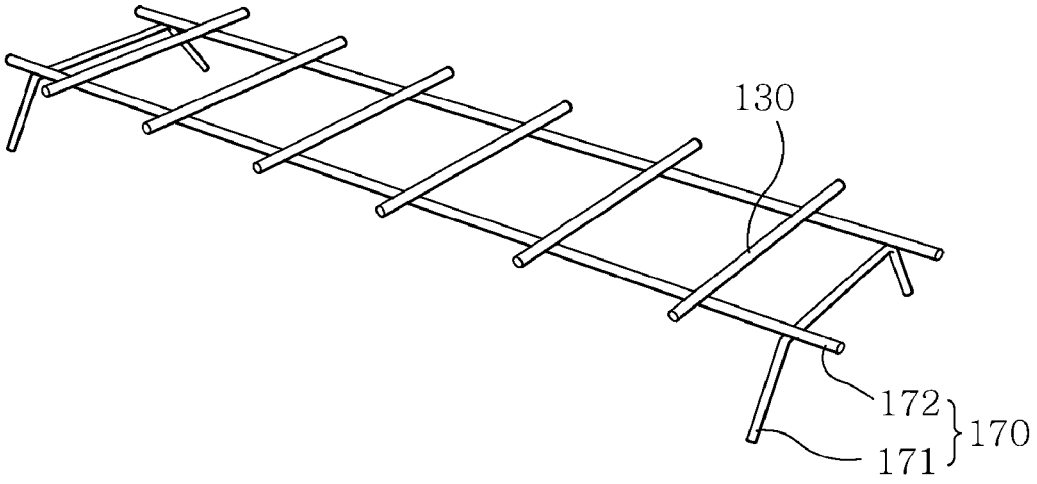
FIG. 7 is a perspective view showing an embodiment of a short reinforcing bar arrangement according to the present invention.

Meanwhile, according to a further embodiment of the short reinforcing bar arrangement of the present invention, as shown in FIG. 7, when the crack induction parts 150, 160 shown in FIGS. 5 and 6 are provided, the short reinforcing bars 130 and the continuous reinforcing bars 120 are efficiently arranged. According to the embodiment of the short reinforcing bar arrangement shown in FIG. 7, in a lower part of the crack induction part 150, 160 (not shown), support frames 171 are provided beneath opposite ends of a pair of transverse reinforcing bars 172. The short reinforcing bars 130 are provided on the transverse reinforcing bars 172 supported on the support frames 171 so as to be orthogonal to the transverse reinforcing bars 172, and the continuous reinforcing bars 120 (not shown) are arranged between the short reinforcing bars 130. That is, according to this embodiment of the short reinforcing bar arrangement, the support frames 171, the transverse reinforcing bars 172, and the short reinforcing bars 130 are precast for easy installation at the work place. Due to the installation of the support frames 171, the transverse reinforcing bars 172, and the short reinforcing bars 130, the continuous reinforcing bar 120 is efficiently arranged at the work place.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A reinforced concrete pavement structure, comprising:

a crack induction part;

reinforcement bars extending from the crack induction part and oriented perpendicular to the crack induction part; and a transverse reinforcing bar extending from the crack induction part and oriented parallel to the crack induction part, wherein the reinforcement bars oriented perpendicular to the crack induction part are spaced apart from one another.

2. The structure of claim 1, wherein the crack induction part is embedded in a concrete pavement layer, and wherein the crack induction part comprises an anti-attaching treatment layer on at least one surface of the crack induction part.

3. The structure of claim 2, wherein the crack induction part is made of concrete, comprises a triangular cross-sectional shape, and comprises a rectangular cross-sectional shape extending from the triangular cross-sectional shape, and wherein the anti-attaching treatment layer is applied to a surface of the crack induction part opposite to the inclined surface.

4. The structure of claim 3, wherein the anti-attaching treatment layer is oleophilic as a result of a hydrophobic surfactant applied to the anti-attaching treatment layer.

5. The structure of claim 1, wherein the crack induction part comprises a cut groove formed on an upper surface of a concrete pavement layer.

6. The structure of claim 2, wherein the crack induction part comprises a sheet shaped membrane disposed in the concrete pavement layer.

7. The structure of claim 2, wherein the reinforcement bars oriented perpendicular to the crack induction part are disposed on the transverse reinforcing bar so as to be orthogonal to the transverse reinforcing bar, and a continuous reinforcing bar is arranged between the reinforcement bars.

8. The structure of claim 3, wherein the reinforcement bars oriented perpendicular to the crack induction part are embedded in an area of the rectangular cross sectional shape of the crack induction part so as to be exposed at opposite ends of the transverse reinforcement bar, the transverse reinforcing bar is embedded in a lower part of the crack induction part, an opening is formed between portions of the crack induction part in which the reinforcement bars oriented perpendicular to the crack induction part are embedded so as to expose the transverse reinforcing bar, and a continuous reinforcing bar is arranged in the opening so as to be supported by the transverse reinforcing bar.

9. The structure of claim 8, further comprising an assistant transverse reinforcing bar, wherein the reinforcement bars oriented perpendicular to the crack induction part comprise downward bent parts at opposite ends, the assistant transverse reinforcing bar is disposed between the downward bent parts, and wherein the continuous reinforcing bar is supported by the transverse reinforcing bar and the assistant transverse reinforcing bar.

10. A method of manufacturing a transformed continuously reinforced concrete pavement structure, the method comprising:

combining a crack induction part with reinforcement bars and a transverse reinforcing bar; and configuring the reinforcement bars in a concrete pavement layer of a continuously reinforced concrete pavement (CROP) structure, wherein the reinforcement bars, other than the transverse reinforcing bar, extend from the crack induction part and are oriented perpendicular to the crack induction part, wherein the transverse reinforcing bar extends from the crack induction part and is oriented parallel to the crack induction part, and wherein the reinforcement bars oriented perpendicular to the crack induction part are spaced apart from one another.

* * * * *